US009170066B2

(12) United States Patent
Cort

(10) Patent No.: US 9,170,066 B2
(45) Date of Patent: Oct. 27, 2015

(54) ADAPTER KIT AND METHOD FOR A PAINTBALL MARKER WITH A .68 CALIPER BARREL

(71) Applicant: Paintball Innovations, Inc, Everett, WA (US)

(72) Inventor: Donald Cort, Everett, WA (US)

( * ) Notice: Subject to any disclaimer, the term of this patent is extended or adjusted under 35 U.S.C. 154(b) by 0 days.

(21) Appl. No.: 14/182,210

(22) Filed: Feb. 17, 2014

(65) Prior Publication Data

US 2014/0230802 A1 Aug. 21, 2014

Related U.S. Application Data

(60) Provisional application No. 61/765,244, filed on Feb. 15, 2013.

(51) Int. Cl.
*F41B 11/62* (2013.01)
*F41B 11/70* (2013.01)
*F41A 21/48* (2006.01)

(52) U.S. Cl.
CPC ..... *F41B 11/70* (2013.01); *F41A 21/482* (2013.01); *F41B 11/62* (2013.01)

(58) Field of Classification Search
CPC ..... F41B 11/62; F41B 11/66; F41B 11/721; F41B 11/70; F41A 21/482
USPC ..... 124/73, 56, 84, 83, 58, 59, 85; 42/76.01
See application file for complete search history.

(56) References Cited

U.S. PATENT DOCUMENTS

| | | | | |
|---|---|---|---|---|
| 5,363,769 | A * | 11/1994 | Bellak et al. | 102/446 |
| 6,273,080 | B1 * | 8/2001 | Sullivan, Jr. | 124/84 |
| 6,668,815 | B1 * | 12/2003 | Fernandez | 124/83 |
| 6,698,128 | B2 * | 3/2004 | Kessler | 42/76.01 |
| 7,980,238 | B2 * | 7/2011 | Wood | 124/84 |
| 2002/0179074 | A1 * | 12/2002 | Sullivan, Jr. | 124/56 |
| 2003/0041849 | A1 * | 3/2003 | Perry et al. | 124/84 |
| 2005/0066953 | A1 * | 3/2005 | Zouboulakis | 124/73 |
| 2009/0133681 | A1 * | 5/2009 | Yeh | 124/56 |
| 2011/0000474 | A1 * | 1/2011 | Wood | 124/73 |

* cited by examiner

*Primary Examiner* — Samir Abdosh
*Assistant Examiner* — John D Cooper
(74) *Attorney, Agent, or Firm* — Dean A Craine

(57) ABSTRACT

A paintball marker adapter kit that enables a paintball marker with a .68 caliber barrel to use .50 caliber paintballs. In one embodiment, the kit includes a hollow barrel tube, a replacement power tube, a replacement linkage arm, and optional feed ball adapters that into the marker's existing ammo feed hopper or a replacement ammo feed hopper. The barrel tube includes a rear bolt section that extends longitudinally from the proximal end of the barrel. The marker's existing front bolt, power tube and linkage arm are removed and replaced by the replacement power tube and replacement linkage arm. The barrel tube is hollow with a center bore configured to receive a .50 caliber paintball and receive the front air tube on the power tube. The barrel tube also includes a ball hole configured for a .50 caliber paintball that drops vertically from the ammo feed elbow and a blocking pin and latch hole. The kit may include a velocity limiting device that fits into the power tube.

15 Claims, 7 Drawing Sheets

ADAPTER KIT AND METHOD FOR A PAINTBALL MARKER WITH A .68 CALIPER BARREL

This utility patent application is based upon and claims the filing date benefit of U.S. provisional patent application (Application No. 61/765,244) filed on Feb. 15, 2013.

BACKGROUND OF THE INVENTION

1. Field of the Invention

This invention relates to paintball marker conversion kits for converting a paintball marker that use .68 caliber paintballs to use .50 caliber paintballs.

2. Description of the Related Art

The Tippmann 98 Custom is a popular pneumatic paintball marker used by many paintball players. The Tippmann 98 Custom paintball marker standard size barrel, power tube and hopper all designed to be used with a .68 caliber paintball. The velocity of the marker is adjustable and normally reduced to reduce the impact force (joules of energy) of a paintball on the opposing player to a safe level. While paintball park operators reduce the velocity of the markers to reduce impact forces to a safe level per insurance and ASTM standards, many players use their own markers with the velocity settings at their maximum allowable amount for greater accuracy and range. One way to reduce a paintball marker's impact force is to reduce the size of the paintball to .50 caliber. Most paintball markers sold today are designed for only one caliper size paintball.

Paintball field operators often provide an indoor field and/or outdoor field to their customers. The indoor fields are typically smaller thereby forcing the players to shoot at each other at closer ranges. Also, most indoor fields also do not have head winds that typically reduce the flight velocity of the paintballs. Because the impact force of .50 caliber markers is less than .68 caliper markers, many paintball indoor field operators offer .50 caliber paintball markers as an alternative to the higher impact, .68 caliber paintball markers.

SUMMARY OF THE INVENTION

The present invention provides an adapter kit and method for converting a paintball marker with a .68 caliber barrel for use with .50 caliber paintballs. The first embodiment of the kit is used with an existing in-line valve, .68 caliber paintball marker that typically includes a barrel with a bore configured for use with .68 caliber paintballs, a front bolt, a power tube, linkage arm, and a rear bolt. A second kit is also disclosed designed to be used with spool valve, .68 caliber paintball markers.

Initially, the outer shell of the paintball marker is removed exposing the interior components. In the first embodiment, the adapter kit includes barrel tube with an integrally formed or attached front bolt section, a replacement power tube, a replacement linkage arm, and optional feed port adapter that fits into the marker's existing ammo feed elbow or into a replacement ammo feed elbow. When using the first adapter kit, the marker's front bolt, power tube, and linkage arm are also removed and the replacement power tube is removed from the kit and inserted into power tube cavity. The new power tube has a shorter outlet tube designed to fit into the proximal end of the barrel tube. The new power tube is positioned in front of the marker's existing rear bolt.

The barrel tube from the kit is then inserted into the body of the marker to replace both the original barrel and the front bolt. The barrel tube is slightly shorter than the barrel and includes a front bolt section that extends longitudinally from the proximal end of the barrel.

The marker's original linkage arm is then removed and replaced by the replacement linkage arm and connected at its opposite end to a bore or nut formed or attached to the top surface on the exposed bolt section on the new barrel tube and to an existing receiving bore formed on the top of the rear bolt. The .68 caliber barrel is then installed.

The barrel tube is hollow with a center bore configured to receive a .50 caliber paintball. The center bore extends the entire length of the barrel tube and receives the outlet tube on the power tube. Formed on the top surface of the barrel tube is a ball hole that receives a .50 caliber paintball that drops vertically from the ammo feed hopper on the top of the marker's receiver housing. The barrel tube includes a transversely aligned blocking pin located behind the ball hole that prevents a paintball deposited in the barrel tube bore from rolling rearward. The barrel tube also includes a ball latch bore through which the marker's existing ball latch extends to prevent forward movement of the paintball delivered to the barrel tube.

The first embodiment of the adapter kit may also include a velocity limiting device that fits into the front section of the power tube. The velocity limiting device is configured to reduce the amount of air traveling into the barrel which reduces the velocity of a .50 caliper paint ball from approximately 225 ft per second to 150 ft per second.

A second embodiment of the adapter kit is also disclosed for use with spool valve type markers that use a rear bolt assembly with an elongated neck that extends rearward into a rear bolt cap. Inside the rear bolt cap a firing chamber is formed and a transversely aligned bolt sail is held in a fixed position inside the rear bolt cap through which the neck of the rear bolt assembly extends.

In the second embodiment, the rear bolt is removed and replaced by the combined barrel tube and rear bolt assembly unit. The kit uses a modified barrel tube includes one or more biased detent fingers that extend into the barrel bore that prevent a paintball from rolling forward in the barrel. When discharged, the detent fingers are automatically forced outward by the paintball. Attached to the proximal end of the modified barrel tube is a modified rear bolt that extends into the rear bolt cap.

The kit also includes a modified rear bolt assembly with a glide stem that includes with an elongated slot and an indexer disposed over the glide neck that prevents rotation of the modified rear bolt assembly and decreases the volume of pressurized air inside the firing chamber in the rear bolt cap when the marker is discharged which reduces the velocity of the paintball discharged from the barrel. The indexer is a hollow cylindrical structure and may include an optional large hole formed on its side wall that allows pressurized air discharged into the firing chamber to fill the entire chamber.

Another purpose of the indexer is to prevent rotation of the unit inside the marker so the ball hole is aligned with the ball hole drop on the marker. The distal end of the rear bolt assembly is affixed to the distal end of the barrel tube to rotatably lock them together. Mounted on the indexer is a transversely aligned pin that extends through an elongated slot formed on the stem. During assembly, the indexer is held in a fixed position inside the rear bolt cap. When the marker is discharged, the rear bolt assembly is forced forward towards the barrel tube. As the rear bolt assembly travels forward, the elongated slot slides over the pin preventing the rear bolt assembly from rotating.

In both kits, elastic sealing O-rings are provided that are disposed around the proximal and mid sections of the barrel tube to provide an airtight seal between the barrel and the barrel tube. Because the inside diameter of the bores on the barrels may vary slightly, optional elastic alignment rings may also be provided that are disposed around the distal end of the barrel tube to coaxially aligned the distal end of the barrel tube in the barrel. In one embodiment, one size O-ring is used and two or more different diameter o-ring grooves are formed on the distal end of the barrel tube that allows the operator to accommodate barrel bores with different inside diameters.

DESCRIPTION OF THE PREFERRED EMBODIMENT(S)

Figure 2:
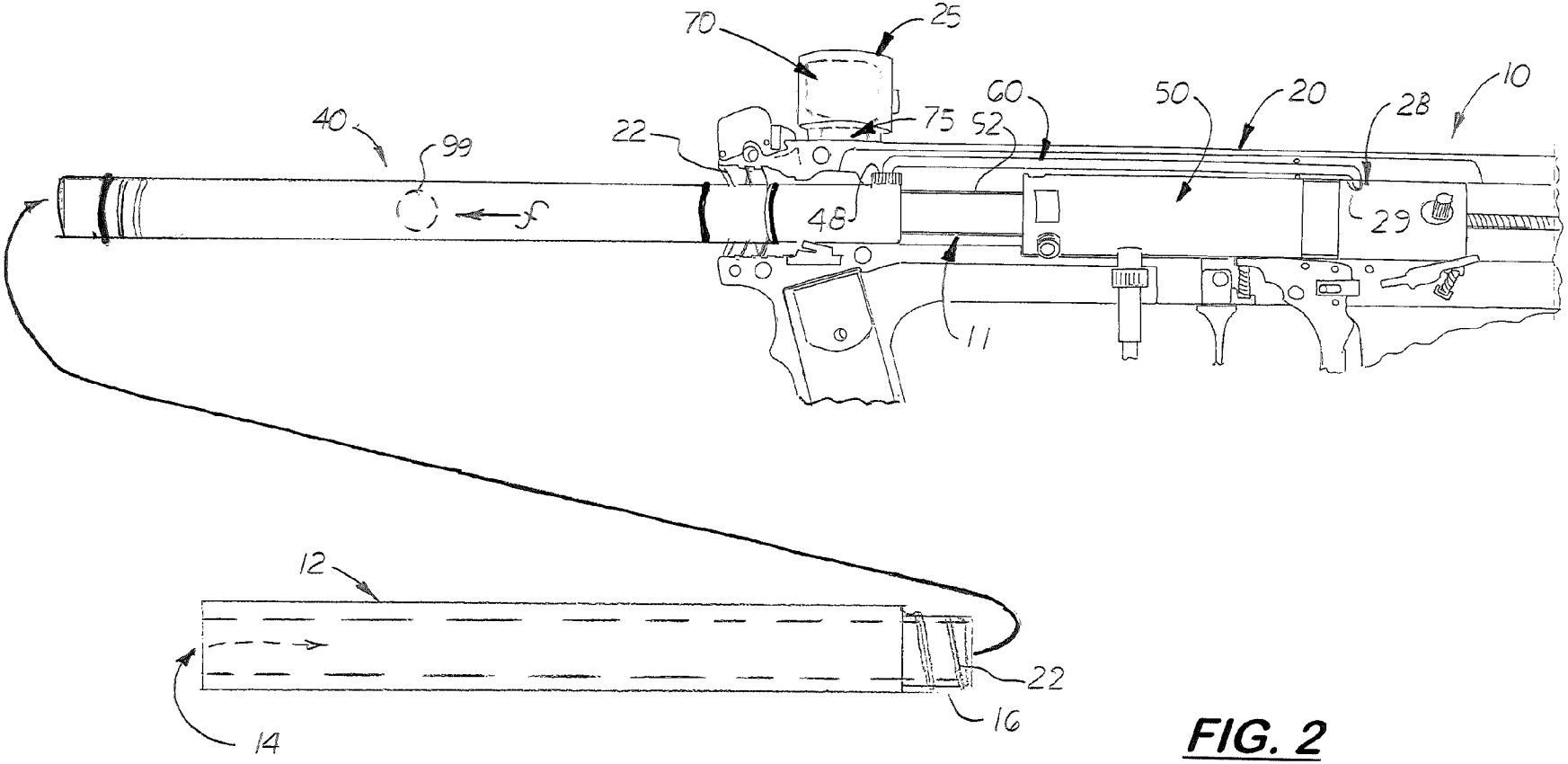
FIG. 2 is a partial side elevational view of a paintball marker showing the hollow barrel tube, the replacement power tube, the replacement linkage arm mounted in the marker and showing the barrel removed.

Disclosed herein is an adapter kit 15 for converting a .68 caliber paintball marker 10 with a .68 caliber barrel 12 into a marker 10 that can be used with 50 caliper paintballs 99. There are two versions or embodiments of the adapter kit, denoted as 15 and 315. The first adapter kit 15 is used with an existing in-line valve, .68 caliber paintball marker shown in FIG. 2, and the second kit 315 is used with spool valve, .68 caliber paintball markers.

Figure 1:
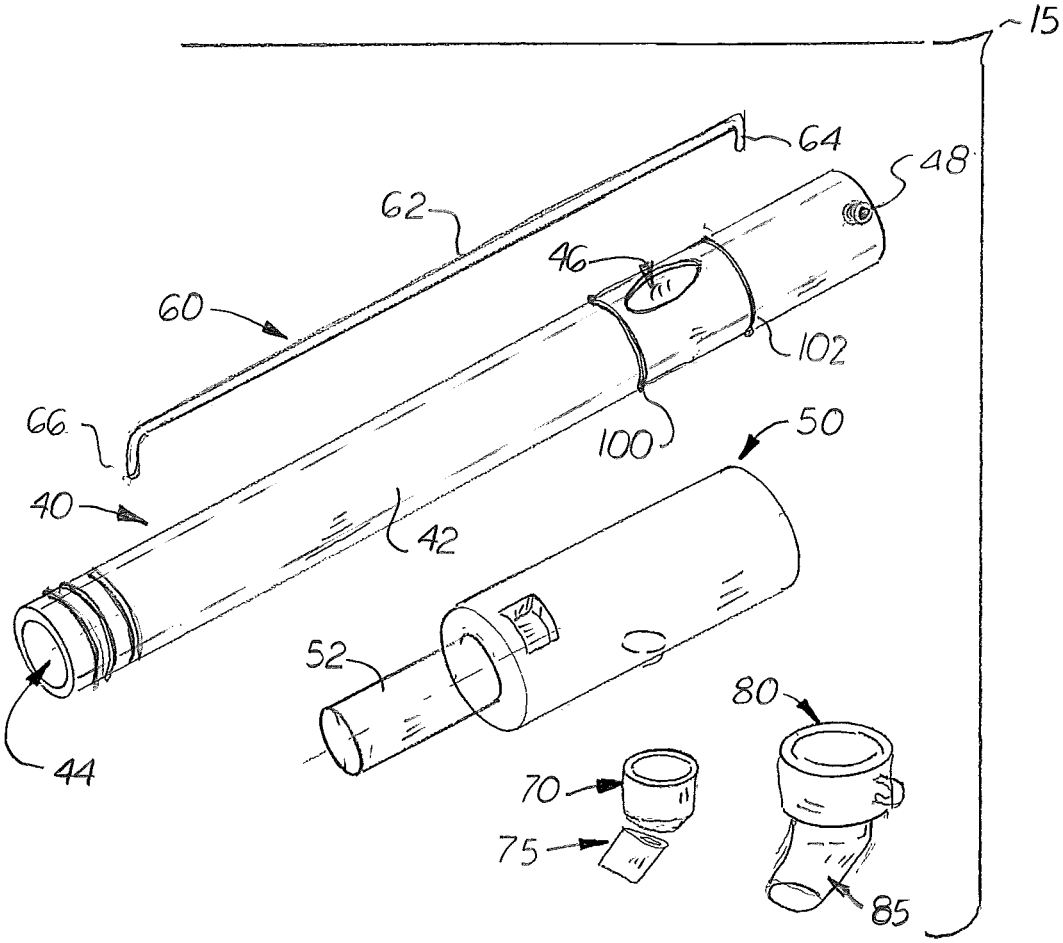
FIG. 1 is perspective view of the first embodiment of the .50 caliper paintball adapter kit disclosed herein.

As shown in FIG. 1, the adapter kit 15 includes a hollow barrel tube 40, a replacement power tube 50 a replacement link arm 60 and optional feed elbows adapters 70, 75, or a replacement feed elbow 80 and a velocity limiting device 120. (see FIG. 7) The barrel tube 40 includes a hollow cylindrical tube body 42 designed to be inserted into the paintball marker's existing .68 caliber barrel 12. The barrel 12 has a center bore 14 that extends the barrel's entire length and external threads 16 that connect to internal threads 22 on the distal end of the marker's receiver body 20. The tube body 42 is configured to slide longitudinally slide inside the bore 14 formed in the barrel 12 has a fully extending bore 44 configured to be used with .50 caliber paintballs 99. When assembled, the proximal end of the tube body 42 extends beyond the proximal end of the barrel 12 and terminates inside the marker's discharge chamber 11.

The marker's existing front bolt and existing linkage arm are removed and the front air tube 52 on the replacement power tube 50 is extended into the bore 44 on the proximal end of the tube body 42. The replacement power tube 50 has a shorter outlet tube 52 normally found on the existing power tube. The replacement linkage arm 60 has an end peg 66 shorter than the marker' existing linkage arm. As shown in FIG. 1, the linkage arm 60 includes a long rod 62 with two perpendicular aligned end pegs 64, 66 at its opposite ends that extend into holes 48, 29, or cavities formed on the tube body 42 and on the marker's existing rear bolt 28, respectively. During operation, the replacement linkage arm 60 is coupled with the tube body 42 and the rear bolt 28 to connect them together so they slide simultaneously in the marker body.

Formed on the top surface of the tube body 42 is a ball bore 46 that receives a .50 caliber paintball 99. Extending transversely inside the tube body 42 and behind the ball hole 46 is a blocking pin 90 that prevents a paintball 99 when deposited in the tube body 42 from rolling rearward. Also formed on the lower surface of the tube body 42 approximately below and slightly in front of the ball hole 46 is a ball latch bore 48 through which the marker's existing ball latch 94 extends to block forward movement of a paintball 99 in the tube body 42.

Figure 5:
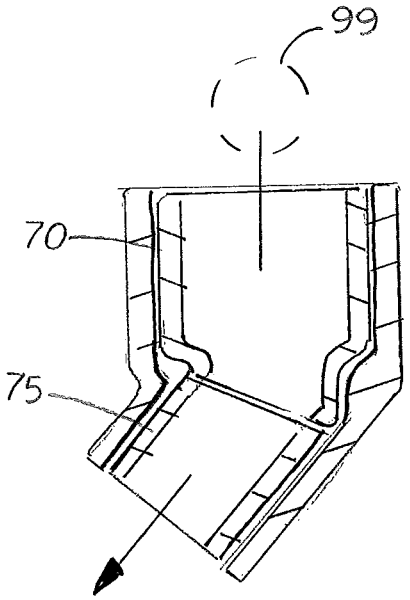
FIG. 5 is a sectional side elevational view to adapters that fit into the marker's existing ammo feed elbow.
Figure 6:
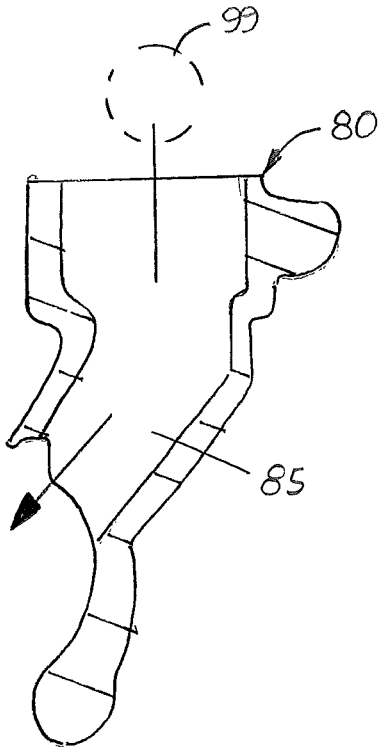
FIG. 6 is a sectional side elevational view of a replacement ammo feed elbow.

The kit 15 also includes either two feed elbow adapters 70, 75 shown in FIGS. 5 and 6 designed to fit into the marker's existing feed elbow 25 or a replacement feed elbow 80. In the embodiment shown herein, the feed adapters 70, 80 include a lower insert member 75, 85, respectively, that fit into the elbows angled bore 46. When .50 caliber paintballs 99 are placed into the hopper (not shown) attached to the elbow 25 adapter 70 or 75, they travel individually through the upper elbow insert adapter 70 or 75 and into the ball hole 46 formed on the tube body 42.

Figure 7:
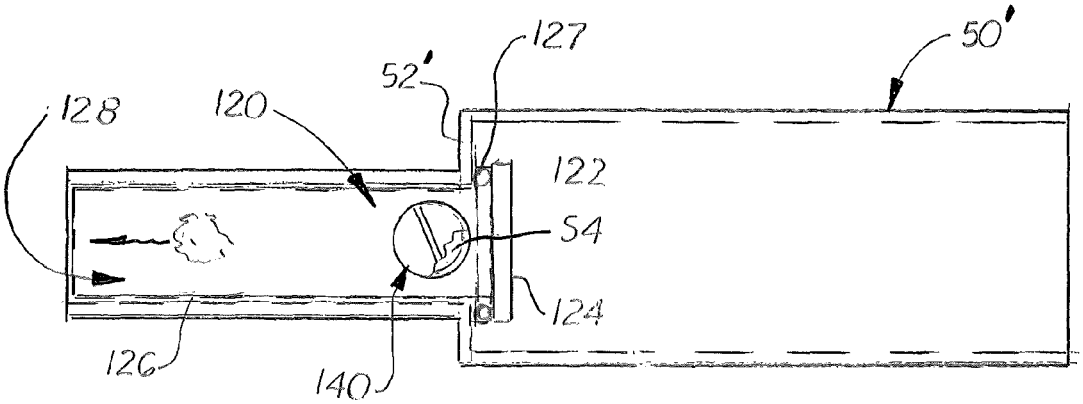
FIG. 7 is a modified power tube with a velocity limiting device mounted therein.

The kit 15 may also includes a velocity limiting device 120 that fits into the front section of a modified power tube 50' as shown in FIG. 7. The velocity limiting device 120 includes a cylindrical, T-shaped body 122 configured to fit into the center bore formed on the power tube 50'. The body 122 includes a large diameter end disc 124 with an elongated stem 126. Disposed around the stem 126 and adjacent to the end disc 124 is a sealing o-ring 127. A continuous bore 128 extends longitudinally inside the body 122. The O-ring 127 and the end disc 124 abuts against the inside end surface 52' of the power tube 50'. The sealing o-ring 127 creates a seal between the end disc 124 and the power tube 50'.

Threaded side bores 54' and 130 are formed on the neck of the power tube 50' and the elongated stem 126, respectively, that when aligned, received a threaded screw 140 that securely holds the velocity limiting device 120 in place on the power tube 50'. During use, the velocity limiting device 120 reduces the amount of air traveling into the barrel tube 42 which reduces the velocity of a .50 caliper paintball 99 from approximately 225 ft per second to 150 ft per second.

FIGS. 10-14 show a second embodiment of the adapter kit, denoted as 315 used with spool valve type markers that use front and rear bolt assemblies and do not use a ball latch in the lower portion of the body that extends into the barrel. To use the second adapter kit 315, the existing .68 caliber barrel, the rear bolt are removed and a combination barrel tube rear bolt assembly unit 340 from the kit 315 is inserted. The unit 340 includes a modified barrel tube 342 includes two biased detent fingers 350, 355 that extend into the barrel bore that prevent a paintball 99 from rolling forward in the barrel.

When discharged, the detent fingers 350, 355 are automatically forced outward by the paintball 99.

Attached to the proximal end of the modified barrel tube 342 is a modified rear bolt assembly 400 that extends into the discharge chamber formed inside and marker's existing rear bolt cap 500. The modified rear bolt assembly 400 includes a forward extending bolt stop 410 that attaches to the proximal end of the modified barrel tube 342 locking the two components together. Disposed around the bolt stop 410 are a plurality of O-rings 413, 417 that create an air tight seal. Integrally formed on the bolt stop 410 is a narrow glide stem 420 with an end cap valve 430 integrally formed on its end. During assembly, the end cap valve 430 fits into the discharge shoot that communicates with the discharge chamber 510 inside the rear bolt cap 500.

Disposed around the glide stem 420 is an indexer 450 comprising a hollow, cylindrical body 452 with transversely aligned pin 454 that extends through an elongated slot 422 formed on the glide stem 420. The pin 454 prevents rotation of the unit 340 inside the marker and the indexer 450 decreases the volume of pressurized air inside the firing chamber 510 in the rear bolt cap when the marker is discharged which reduces the velocity of the paintball discharged from the barrel. The indexer 450 is a hollow cylindrical structure 452 and may include an optional large hole 456 formed on its side wall that allows pressurized air to fill the entire chamber 510. During assembly, the indexer 450 is designed to fit into the outer cage formed on the rear bolt cap 500.

In the embodiment shown, the stem 420 measures 1.75 inches in length and the slot 422 measures 1.42 inches in length and 0.135 inches in width. The indexer 450 has an inside diameter of 0.602 inches, is 1.68 inches in length, and has an outside diameter of 803 inches. The pin 454 is 0.75 inches in length and 0.125 inches in diameter.

Figure 3:
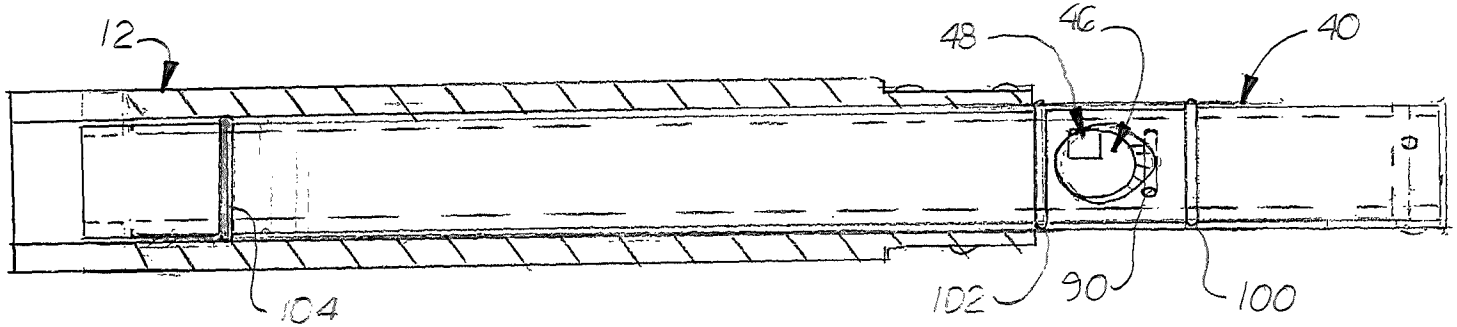
FIG. 3 is a sectional top plan view of a barrel with the barrel tube mounted therein.
Figure 4:
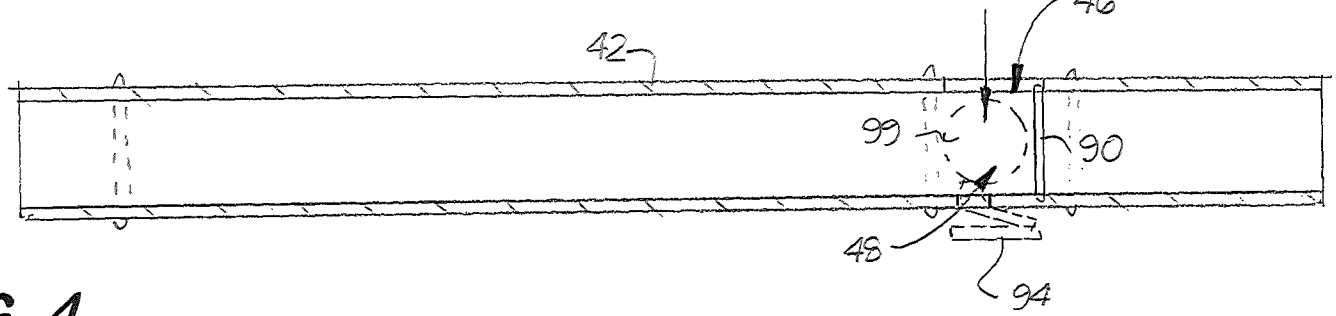
FIG. 4 is a side elevational view of the barrel tube.

In both kits 15, 315, disposed around the proximal end of the tube body 42, 342 are two sealing O-rings 100, 102. Disposed around the distal end of the tube body 42 is a front O-ring 104. The sealing O-rings 100 and 102 provide an airtight seal between the inside surface of the barrel 12 and the outside surface of the tube body 42. Disposed around the distal end of the tube body 42, 342 is at least one alignment O-ring 104 that coaxially aligns the distal end of the tube body 42, 342 inside the barrel 12. In the embodiment shown in FIGS. 3 and 10, there are three O-ring grooves 130, 132, 134 formed on the distal end of the tube body 42. The three O-ring grooves 130, 132, 134 vary in diameter. Because the inside diameter of the bore inside the barrel 12 may vary slightly, the three O-ring grooves 130, 132, and 134 also vary in diameter so when the O-ring 104 when disposed in one of the O-ring grooves 130, 132, or 134, the outer diameter of the O-ring 104 is adjusted to press against the inside surface of barrel 12 with slightly different diameters to coaxially aligned the barrel tube 42, 342 inside the barrel 12. In the embodiment shown, the one size O-ring 130 is used and two or more different diameter o-ring grooves (three o-ring grooves shown, 140, 142, 144, (.545, .5525, .560 inches, respectively) are formed on the barrel tube 42, 342, hat allows the operator to accommodate barrel bore's with different inside diameters.

Figure 8:
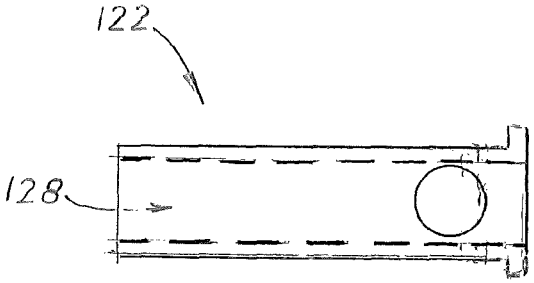
FIG. 8 is a side elevational view of the velocity limiting device.
Figure 9:
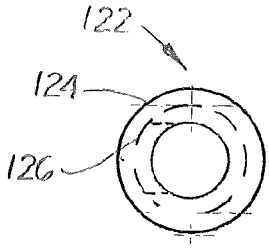
FIG. 9 is an end elevational view of the velocity limiting device.
Figure 10:
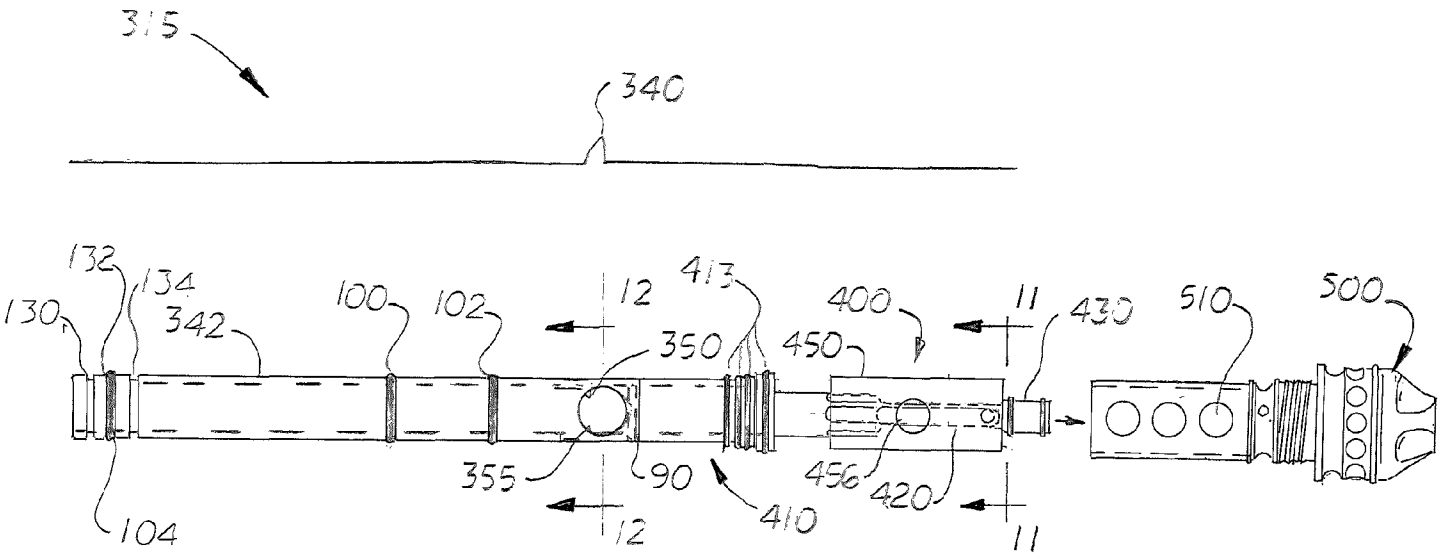
FIG. 10 is side elevational view of the second embodiment of the .50 caliber adapter kit that includes a combination barrel tube and rear bolt assembly unit.
Figure 12:
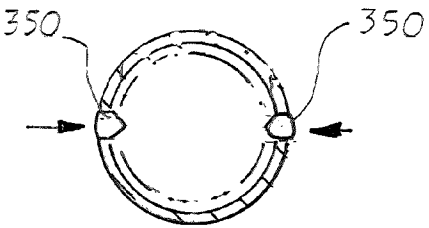
FIG. 12 is a sectional, end view of the modified barrel tube taken along line 12-12 in FIG. 11.
Figure 11:
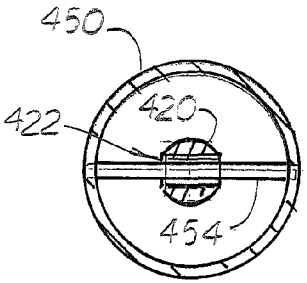
FIG. 11 is sectional, end view of the rear bolt assembly taken along line 11-11 in FIG. 10.
Figure 13:
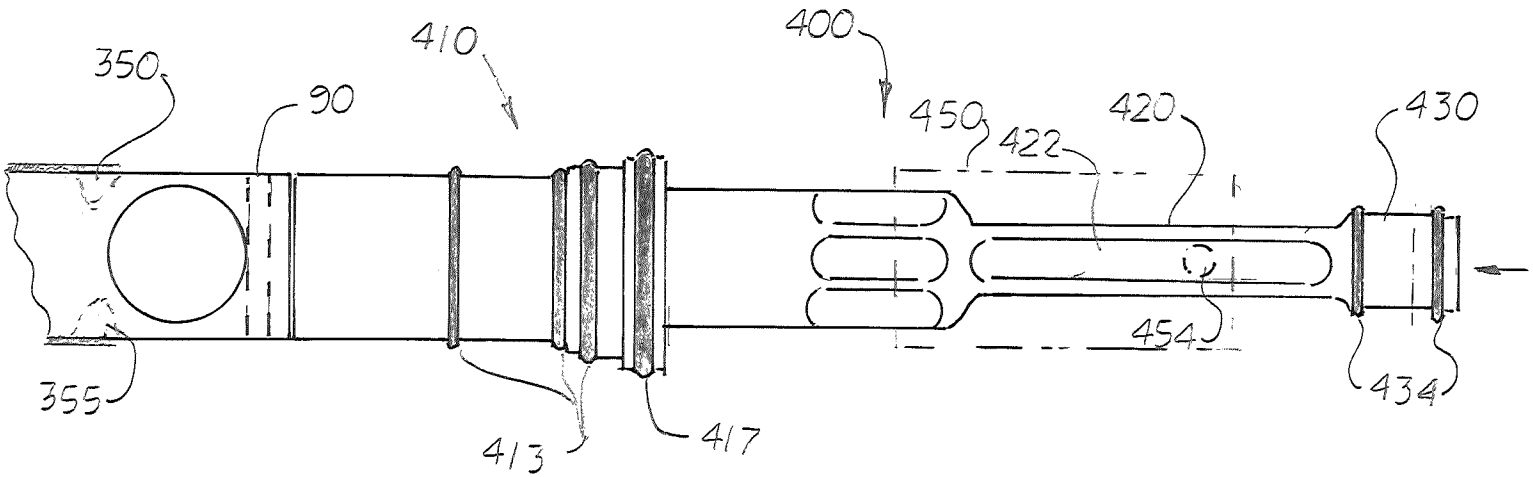
FIG. 13 is a side elevational view of the rear bolt assembly with the indexer removed.

In the velocity limiting device 120 shown in FIGS. 7-9, the body 122 measures 1.40 inch in length and the inner bore 128 is approximately 0.250 inches in diameter. The outer diameter of the end disc 124 is approximately 0.5 inch and the elongated stem 126 is approximately 0.358 inch in diameter and approximately 1.310 inches in length. The thread bores 54', 130 are approximately 0.317 inches in diameter.

In compliance with the statute, the invention described has been described in language more or less specific as to structural features. It should be understood, however, that the invention is not limited to the specific features shown, since the means and construction shown comprises the preferred embodiments for putting the invention into effect. The invention is therefore claimed in its forms or modifications within the legitimate and valid scope of the amended claims, appropriately interpreted under the doctrine of equivalents.

I claim:

1. An adapter kit for converting a paintball marker with a .68 caliber barrel for use with .50 caliber paintballs, the adapter kit comprising: a barrel tube that includes a cylindrical body configured to fit longitudinally inside a bore of the paintball marker's .68 caliber barrel, said barrel tube includes a .50 caliber bore that extends longitudinally the entire length of said barrel tube, a ball hole, a stop pin and a ball latch bore, wherein said ball latch bore receives a ball latch in a receiver of the paintball marker when disposed therein, said barrel tube includes a plurality of sealing O-rings located around its outer surface configured to align and create an air seal between said barrel tube and at least one aligned O-ring disposed around a distal end of said barrel tube to coaxially aligned said barrel tube inside said barrel.

2. The adapter kit as recited in claim 1, further including a plurality of O-ring grooves formed on said distal end of said barrel tube with different diameters that change the outside diameter of said O-ring when disposed therein.

3. The adapter kit, as recited in claim 1, further including a front bolt formed on said barrel tube and a power tube with a short outlet tube configured to extend into said front bolt on said barrel tube; and, a modified linkage arm configured to connect said barrel tube to said power tube.

4. The adapter kit, as recited in claim 1, further including a combination barrel tube rear bolt assembly unit, said unit includes a modified barrel tube that has two biased detent fingers that extend into a barrel tube bore formed on said barrel tube that prevent a paintball from rolling forward in said barrel tube.

5. The adapter kit, as recited in claim 4, wherein said unit further includes a modified rear bolt assembly with a slotted stem and a cylindrical index that fits into the rear bolt cap and includes a pin the fits into said slotted stem and prevents rotation of said unit in said marker.

6. An adapter kit for converting a paintball marker with a .68 caliber barrel for use with .50 caliber paintballs, the adapter kit comprising:

a. a barrel tube that includes a cylindrical body configured to fit longitudinally inside a bore of the paintball marker's .68 caliber barrel, the barrel tube includes a front bolt section that extends rearward from the barrel tube when longitudinally aligned inside the barrel, the barrel tube includes .50 caliber bore that extends longitudinally the entire length of the barrel tube, a ball hole, a stop pin and a ball latch bore, wherein said ball latch bore receives a ball latch in a receiver of the paintball marker when disposed therein, the barrel tube includes a plurality of sealing O-rings located around its outer surface that coaxially aligns and creates an air seal between the barrel tube and the barrel when the barrel tube is placed into the bore of the barrel;

c. a power tube with a short outlet tube configured to the front bolt section on the barrel tube when longitudinally aligned and located behind the barrel tube, and b. a modified linkage arm configured to connect the barrel tube to the power tube used with a .68 caliber paintball marker.

7. The adapter kit, as recited in claim 6, further including at least one alignment ring attached to said barrel tube configured to coaxially align the barrel tube in the barrel of the paintball marker.

8. The adapter kit, as recited in claim 7, further including a plurality of different size o-ring grooves formed on the barrel tube configured to coaxially aligned the barrel tube in different barrel bores.

9. The adapter kit, as recited in claim 8, further include at least one No. 14elastic o-ring configured to fit into an alignment o-ring groove formed on the barrel tube.

10. The adapter kit, as recited in claim 9, wherein three are three o-ring grooves formed on the barrel tube having diameters .545, .5525, .560 inches.

11. The adapter kit as recited in claim 8, wherein said velocity limiting device includes a cylindrical, T-shaped body configured to fit into a center bore formed on said power tube, said body includes a large diameter end disc with an elongated stem and a continuous bore extending longitudinally inside said body with a diameter configured to receive and reduce a volume of air released in the barrel and reduce a velocity of the paintball delivered from said barrel.

12. The adapter kit as recited in claim 7, wherein said velocity limiting device includes a cylindrical, T-shaped body configured to fit into a center bore formed on said power tube , said body includes a large diameter end disc with an elongated stem and a continuous bore extending longitudinally inside said body with a diameter configured to receive and reduce a volume of air released in the barrel and reduce a velocity of the paintball delivered from said barrel.

13. The adapter kit as recited in claim 6, further including at least one feed port adapter configured for placement inside a feed elbow of a .68 caliber paintball marker.

14. The adapter kit as recited in claim 6, further including a velocity limiting device located inside said power tube configured to reduce a velocity of a .50 caliper paint ball exiting said barrel tube.

15. The adapter kit as recited in claim 6, wherein said velocity limiting device includes a cylindrical, T-shaped body configured to fit into a center bore formed on said power tube , said body includes a large diameter end disc with an elongated stem and a continuous bore extending longitudinally inside said body with a diameter configured to receive and reduce a volume of air released in the barrel and reduce a velocity of the paintball delivered from said barrel.

* * * * *